US008783504B2

(12) United States Patent
Kleschinski et al.

(10) Patent No.: US 8,783,504 B2
(45) Date of Patent: Jul. 22, 2014

(54) PRESSURE VESSEL FOR STORING A FLUID

(75) Inventors: Michael Kleschinski, Kassel (DE); Dietmar Müller, Herford (DE)

(73) Assignee: XPERION GmbH, Herford (DE)

( * ) Notice: Subject to any disclaimer, the term of this patent is extended or adjusted under 35 U.S.C. 154(b) by 0 days.

(21) Appl. No.: 13/704,979

(22) PCT Filed: Jun. 17, 2011

(86) PCT No.: PCT/DE2011/075135

§ 371 (c)(1),
(2), (4) Date: Feb. 26, 2013

(87) PCT Pub. No.: WO2012/022321

PCT Pub. Date: Feb. 23, 2012

(65) Prior Publication Data

US 2013/0153583 A1 Jun. 20, 2013

(30) Foreign Application Priority Data

Jun. 17, 2010 (DE) ..... 10 2010 017 413

(51) Int. Cl.
*F17C 1/06* (2006.01)
*F17C 1/04* (2006.01)

(52) U.S. Cl.
CPC ... *F17C 1/06* (2013.01); *F17C 1/04* (2013.01); *F17C 2209/2154* (2013.01)
USPC ..... 220/590; 220/589; 428/36.3

(58) Field of Classification Search
CPC ..... F17C 1/06; F17C 1/04; F17C 1/02; F17C 1/16; F17C 2209/2154
USPC ..... 220/590, 589, 588, 586, 62.19, 62.11, 220/581; 428/36.4, 36.3, 35.7
See application file for complete search history.

(56) References Cited

U.S. PATENT DOCUMENTS 2,718,583 A * 9/1955 Noland et al. ..... 392/458
2,744,043 A * 5/1956 Ramberg ..... 156/155

(Continued)

FOREIGN PATENT DOCUMENTS

DE 4126251 A1 2/1993
DE 19751411 C1 1/1999

(Continued)

OTHER PUBLICATIONS

International Search Report issued by the European Patent Office, dated Nov. 18, 2011, for related International Application No. PCT/DE2011/075135; 6 pages.

(Continued)

*Primary Examiner* — Robert J Hicks
(74) *Attorney, Agent, or Firm* — Faegre Baker Daniels LLP

(57) ABSTRACT

A pressure vessel for storing a fluid, comprises an outer jacket applied to a plastic core container, the outer jacket comprising a first fibre-reinforced reinforcing device with one or several wound layers comprising first fibres that are embedded in a first matrix material, a second fibre-reinforced reinforcing device formed on the outside of the first device and with one or several wound layers comprising second fibres that are embedded in a second matrix material, and an impact-absorbing thickening of the outer jacket in a polar cap region of the plastic core container. The thickening is formed in that one or several wound layers that are thickened in the polar region are formed in at least one of the reinforcing devices with a face opening that is larger than a face opening of other non-thickened wound layers in at least one of the reinforcing devices.

10 Claims, 1 Drawing Sheet

(56) References Cited

U.S. PATENT DOCUMENTS

| | | | | | |
|---|---|---|---|---|---|
| 3,033,724 | A | * | 5/1962 | Stokes | 156/187 |
| 3,266,660 | A | * | 8/1966 | Ragettli | 206/521 |
| 3,815,773 | A | * | 6/1974 | Duvall et al. | 220/590 |
| 4,438,858 | A | | 3/1984 | Grover | |
| 4,699,288 | A | * | 10/1987 | Mohan | 220/590 |
| 5,018,638 | A | | 5/1991 | Auberon et al. | |
| 5,025,943 | A | * | 6/1991 | Forsman | 220/589 |
| 5,429,845 | A | | 7/1995 | Newhouse et al. | |
| 5,476,189 | A | | 12/1995 | Duvall et al. | |
| 5,499,739 | A | * | 3/1996 | Greist et al. | 220/589 |
| 6,145,692 | A | | 11/2000 | Cherevatsky | |
| 6,230,922 | B1 | * | 5/2001 | Rasche et al. | 220/586 |
| 7,032,769 | B2 | | 4/2006 | Iida et al. | |
| 2005/0087536 | A1 | | 4/2005 | Caudill et al. | |
| 2006/0096993 | A1 | | 5/2006 | Takashima | |
| 2007/0012551 | A1 | * | 1/2007 | Rohwer et al. | 200/61.22 |
| 2007/0246461 | A1 | * | 10/2007 | Shimada et al. | 220/4.12 |
| 2008/0111322 | A1 | | 5/2008 | Otsubo et al. | |
| 2009/0236349 | A1 | | 9/2009 | Mueller et al. | |

FOREIGN PATENT DOCUMENTS

| | | | | | |
|---|---|---|---|---|---|
| DE | 10345159 | A1 | | 2/2005 | |
| DE | 102005053245 | A1 | | 5/2006 | |
| DE | 102006001052 | A1 | | 9/2007 | |
| DE | 69737236 | T2 | | 10/2007 | |
| DE | 102006043582 | B3 | | 3/2008 | |
| DE | 102007011211 | B3 | | 8/2008 | |
| EP | 0666450 | A1 | | 8/1995 | |
| EP | 1526325 | A2 | | 4/2005 | |
| JP | 09004712 | A | * | 1/1997 | F16J 12/00 |

OTHER PUBLICATIONS

Office Action issued by the German Patent and Trademark Office, dated Jun. 2, 2011, for related Application No. 10 2010 017 413.0; 12 pages.

English translation of the International Preliminary Report on Patentability issued by The International Bureau of WIPO, Geneva, Switzerland, dated Dec. 19, 2012, for related International Application No. PCT/DE2011/075135; 9 pages.

* cited by examiner

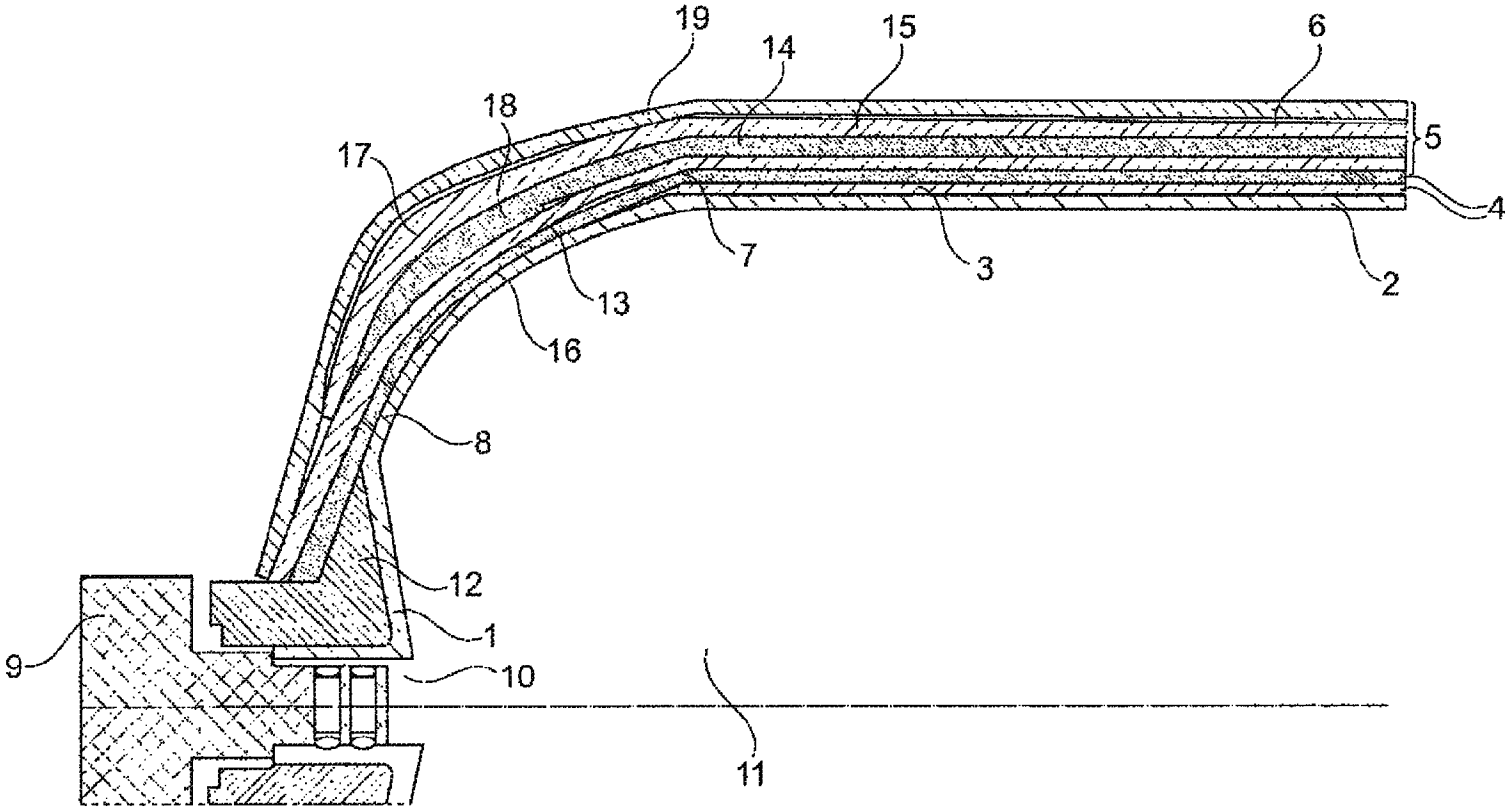
4
5
2
6
3
15
14
7
19
13
16
18
8
12
1
10
17
11
9

PRESSURE VESSEL FOR STORING A FLUID

CROSS-REFERENCE TO RELATED APPLICATIONS

This application is a U.S. National Phase Patent Application based on International Application No. PCT/DE2011/075135 filed Jun. 17, 2011, which claims priority to German Patent Application No. 10 2010 017 413.0, filed Jun. 17, 2010, the entire disclosures of which are hereby explicitly incorporated by reference herein.

TECHNICAL FIELD

The invention relates to a pressure vessel for storing a fluid, which pressure vessel comprises a plastic core container and an outer jacket applied to the plastic core container.

BACKGROUND

Such pressure vessels are used for storing fluid or gaseous media, in other words pressurized fluids. Pressure vessels of this type are, for example, known from the following documents: DE 10 2006 001 052 A1; DE 10 2006 043 582 B3; and DE 10 2007 011 211 B3.

It has been proposed in such pressure vessels in the region of so-called polar caps, namely in the transition region between the face and the circumference of the plastic core container to provide impact-absorbing or fall-absorbing protective elements. In this manner, undesirable damage to the pressure vessel is to be avoided, in particular when said pressure vessel is knocked over or falls down. In this arrangement the protection device is to provide protection in particular in the case of an angle of impact of approximately 45° to the longitudinal axis of the pressure vessel. Protective caps comprising plastic material in the region of the polar caps are proposed as impact protection devices or strike protection devices (compare DE 197 51 411 C1 and U.S. Pat. No. 5,476,189).

Furthermore, a pressure vessel is known from the document U.S. Pat. No. 5,429,845.

SUMMARY

In one embodiment, the present invention provides an improved pressure vessel for storing a fluid, comprising a plastic core container and an outer jacket applied to the plastic core container, in which pressure vessel a shock protection device and impact protection device can be made in a manner that is simple in terms of production technology.

The invention encompasses a pressure vessel for storing a fluid, comprising a plastic core container and an outer jacket applied to the plastic core container wherein the outer jacket comprises the following characteristics:

- a first fibre-reinforced reinforcing device with one or several wound layers (windings) comprising first fibres, which layers are embedded in a first matrix material,
- a second fibre-reinforced reinforcing device that relative to the first reinforcing device is formed on the outside and by means of one or several wound layers (windings) that comprise second fibres, wherein the second fibres optionally are different from the first fibres and are embedded in a second matrix material that optionally differs from the first matrix material, and
- an impact-absorbing thickening of the reinforcing device in a polar cap region, namely the transition region between the face and the circumference of the plastic core container, and optionally adjacent to the aforesaid, wherein the impact-absorbing thickening of the reinforcing device is formed in that one or several wound layers that are thickened at the polar caps are formed in the first thickening of the reinforcing device and/or in the second thickening of the reinforcing device with a face opening that is larger than the face opening of wound layers in the first and/or in the second reinforcing device, which wound layers are not thickened at the polar caps.

When compared to pressure vessels according to the state of the art, the proposed pressure vessel provides an advantage in particular in that forming the impact protection and shock protection device takes place in the region of the polar caps, and optionally adjacent to the aforesaid, during manufacture of the fibre-reinforced reinforcing or armor devices, in other words during manufacture of the wound layers. When compared to the state of the art it is not necessary in further production steps to additionally incorporate plastic elements, for example foamed plastic elements, in the outer jacket. In this manner the manufacturing process for the pressure vessel is optimized The impact-absorbing thickening of the reinforcing or armor device increases the wall thickness in the cylindrical region of the pressure vessel. Consequently the robustness of the system is improved.

In one embodiment the first fibre-reinforced reinforcing or armor device can exclusively be formed with the first fibres. As an alternative or as a supplement, in one embodiment it can be provided that exclusively the second fibres be used in the second fibre-reinforced reinforcing device. The first matrix material and the second matrix material can be identical or they can differ. Preferably, thermoplastic or duroplastic resin systems are used that serve to impregnate the respective reinforcing device.

It can be provided for the impact-absorbing thickening of the reinforcing device to be produced in the top region and/or in the bottom region of the pressure vessel. Consequently a thickening of the reinforcing device on one face or on both faces is created on the pressure vessel. In one embodiment the polar cap region in the top region and/or in the bottom region of the pressure vessel is produced free of any further impact-absorbing or fall-absorbing elements. In this embodiment the impact protection or fall protection is thus formed exclusively by means of the impact-absorbing thickening of the reinforcing device, which thickening is based on the wound layers that are thickened at the polar caps.

According to one aspect of the invention, in a neck region of the plastic core container, in an opening communicating with the interior space of the plastic core container, a neck piece for closing and/or sealing the interior space is arranged, wherein the wound layers that are not thickened at the polar caps are designed so as to at least partially overlap with a collar of the neck piece, and the one or several wound layers that are thickened at the polar caps are formed so as not to overlap with the collar of the neck piece. In one embodiment the neck piece comprises metal. In an improvement of the invention, the wound layers that are not thickened at the polar caps can be designed so as to fully overlap the collar of the neck piece. The collar can, for example, be designed in the shape of a truncated cone.

In an expedient embodiment of the invention it can be provided that the one or several wound layers that are thickened at the polar caps are exclusively formed in the second reinforcing device. In this embodiment the first reinforcing device does not comprise wound layers that are thickened at the polar caps.

One embodiment of the invention provides that the second fibres in the one or several wound layer/s that are thickened at the polar caps are arranged at an angle of between 25° and 65°, preferably at an angle of between 35° and 55° to the longitudinal axis of the plastic core container.

Preferably, an improvement of the invention provides that the first fibres in the wound layers that are not thickened at the polar caps are arranged at an angle of between 5° and 25° to the longitudinal axis of the plastic core container.

In one embodiment of the invention it can be provided that the first reinforcing device and/or the second reinforcing device comprise at least one wound circumferential layer along the circumference of the plastic core container. The wound circumferential layer leaves the faces of the plastic core container free. In an improvement of the invention, one or several wound layer/s that is/are not thickened at the polar caps can have been applied to the at least one wound circumferential layer.

An improvement of the invention can provide that the first fibres are carbon fibres, and the second fibres are glass fibres. As an alternative it can be provided that in each case only glass fibres or only carbon fibres be used in both reinforcing devices. As an alternative to glass fibre and/or carbon fibre the following types of fibre can be used: aramid fibre; polyamide fibre; polyester fibre; or basalt fibre.

A preferred improvement of the invention provides that an outer wound layer of the second reinforcing device is a wound layer that is not thickened at the polar cap regions.

In an expedient embodiment of the invention it can be provided that an inner wound layer of the second reinforcing device that closes off the second reinforcing device towards the plastic core container is a wound layer that is not thickened at the polar caps.

An advantageous embodiment of the invention provides that several wound layers thickened at the polar caps are formed so as to be lying directly on top of each other.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 1 is a cross-sectional view of a pressure vessel for storing a fluid such as a gas or a liquid according to the teachings of the present disclosure.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 shows a cross section of a pressure vessel for storing a fluid, in other words a gas or a liquid. In a circumferential region 2 a circumferential layer 3 has been applied to a plastic core container 1 that is also referred to as a liner. In the embodiment shown, carbon fibres are used as first fibres, which have been wound on at an angle of between approximately 60° and approximately 90° to the longitudinal axis of the pressure vessel.

The first fibres of the circumferential layer 3 are embedded in a matrix material that is a thermoplastic or duroplastic resin system. Embedding the wound fibres (winding) in the matrix material is also referred to as impregnating. An identical material or a material that differs from that of the matrix material of the circumferential layer 3 can be used for the further wound layers (windings) of fibres, which layers are described below, wherein in this embodiment, too, thermoplastic or duroplastic resin systems are used.

The circumferential layer 3 forms part of a first fibre-reinforced reinforcing or armor device 4 that has been applied to the plastic core container 2. In the exemplary embodiment shown the first fibre-reinforced reinforcing device 4 together with a second fibre-reinforced reinforcing or armor device 5, which has been applied to the first fibre-reinforced reinforcing device 4, forms an outer jacket 6 on the plastic core container 2.

According to FIG. 1, the first fibre-reinforced reinforcing device 4 is furthermore produced with a wound layer 7 that is designed as a so-called cross-layer and comprises carbon fibres that have been wound at an angle of between approximately 5° and approximately 25° to the longitudinal axis of the pressure vessel. The wound layer 7 has been formed in the circumferential region 2 and in the face region 8 of the pressure vessel right up to a neck piece 9. The neck piece 9, which is made from metal, is arranged in the region of an opening 10 of the plastic core container 1 and is used to close off and/or seal the interior space 11 of the plastic core container 1. In this arrangement the wound layer 7 of the first reinforcing device completely overlaps a collar 12 of the neck piece 9. The neck piece 9 comprises a valve and forms a metal part with the collar 12. The other end of the pressure vessel (bottom end—not shown) can either be identical in design or does not have an opening, i.e. no valve has been inserted. Nonetheless, in either case a corresponding neck piece is formed.

A further layer 13 has been wound onto the wound layer 7, which layer 13 in the exemplary embodiment shown has been made with the use of glass fibres that have been wound at an angle of between approximately 5° and approximately 25° to the longitudinal axis of the pressure vessel. The further layer 13 also completely overlaps the collar 12 of the neck piece 9. The further layer 13 forms a layer of the second fibre-reinforced reinforcing device 5, which layer is next to the plastic core container 1.

According to FIG. 1, two layers 14, 15, thickened at the polar caps, have been applied to the further layer 13 in the second fibre-reinforced reinforcing device 5, which layers 14, 15 have been designed as cross layers and do not overlap with the collar 12 of the neck piece 9, and in the region of a polar cap 16 in each case comprise an impact-absorbing thickening 17, 18 of the reinforcing device, which thickening is also designed so as to improve rigidity in that glass fibres of the layers 14, 15 thickened at the polar caps have been wound at an angle of between approximately 25° and approximately 65°, preferably between approximately 35° and approximately 55° to the longitudinal axis of the pressure vessel.

Lastly, the second fibre-reinforced reinforcing device 5 has been produced so as to comprise an outer wound layer 19 of glass fibres, which layer is not thickened at the polar cap regions, and in which layer the glass fibres that have been used have been wound at an angle of between approximately 5° and approximately 25° to the longitudinal axis of the pressure vessel. The outermost layer 19 overlaps the collar 12 of the neck piece 9.

By means of the polar reinforcements an impact protection device or fall protection device has been produced in a targeted manner in the shoulder region of the pressure vessel.

The exemplary embodiment shown provides for the formation of wound layers that are thickened at the polar caps exclusively in the second fibre-reinforced reinforcing device. In other exemplary embodiments wound layers thickened at the polar caps can be provided either exclusively in the first reinforcing device, or both in the first reinforcing device and in the second reinforcing device. FIG. 1 shows the head region of the pressure vessel. A comparable fall protection device or impact protection device, or a fall protection device or impact protection device designed in some other manner, can also be provided in the bottom region of the pressure vessel, which also comprises an opening, or which can be closed, namely in the polar cap region at that location.

The characteristics of the invention disclosed in the above description, in the claims and in FIG. 1 can be significant individually or in any combination in the implementation of the various embodiments of the invention. Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

The invention claimed is:

1. A pressure vessel for storing a fluid, comprising a plastic core container and an outer jacket applied to the plastic core container, with the outer jacket comprising:

a first fibre-reinforced reinforcing device with one or several wound layers comprising first fibres that are embedded in a first matrix material;

a second fibre-reinforced reinforcing device formed on the outside of the first reinforcing device and with one or several wound layers comprising second fibres that are embedded in a second matrix material; and an impact-absorbing thickening of the outer jacket in a polar region at a transition region between a face and a circumference of the plastic core container, wherein the impact-absorbing thickening is formed in that one or several wound layers that are thickened in the polar region and extend over the circumference are formed in at least one of the first and second reinforcing devices with a face opening that is larger than a face opening of other wound layers in at least one of the first and second reinforcing devices, which wound layers are not thickened in the polar region;

wherein the impact-absorbing thickening formed in the polar region becomes less thick with distance toward the circumference and with distance toward the face, and wherein the second fibres in the one or several wound layers that are thickened in the polar region are arranged in the polar region at an angle of between 25° and 65° to a longitudinal axis of the plastic core container.

2. The pressure vessel according to claim 1, wherein in an opening in a neck region of the plastic core container in communicating with an interior space of the plastic core container, a neck piece for closing the interior space is arranged, and the wound layers that are not thickened in the polar region are formed to at least partially overlap with a collar of the neck piece, and the one or several wound layers that are thickened in the polar region are formed to not overlap with the collar of the neck piece.

3. The pressure vessel according to claim 1, wherein the one or several wound layers that are thickened in the polar region are exclusively formed in the second reinforcing device.

4. The pressure vessel according to claim 1, wherein the second fibres are arranged at an angle of between 35° and 55° to the longitudinal axis.

5. The pressure vessel according to claim 3, wherein the first fibres in the wound layers that are not thickened in the polar region are arranged at an angle of between 5° and 25° to a longitudinal axis of the plastic core container.

6. The pressure vessel according to claim 1, wherein at least one of the first and second reinforcing devices comprises at least one wound circumferential layer along the circumference of the plastic core container.

7. The pressure vessel according to claim 1, wherein the first fibres are carbon fibres, and the second fibres are glass fibres.

8. The pressure vessel according to claim 1, wherein an outer wound layer of the second reinforcing device is a wound layer that is not thickened in the polar region.

9. The pressure vessel according to claim 1, wherein an inner wound layer of the second reinforcing device that closes off the second reinforcing device towards the plastic core container is a wound layer not thickened in the polar region.

10. The pressure vessel according to claim 1, wherein several wound layers that are thickened in the polar region are formed so as to be lying directly on top of each other.

* * * * *